US011289321B2

(12) United States Patent
Cooks et al.

(10) Patent No.: US 11,289,321 B2
(45) **Date of Patent: *Mar. 29, 2022**

(54) ION TRAPS THAT APPLY AN INVERSE MATHIEU Q SCAN

(71) Applicant: Purdue Research Foundation, West Lafayette, IN (US)

(72) Inventors: Robert Graham Cooks, West Lafayette, IN (US); Jason Duncan, Dayton, IN (US); Joshua Wiley, Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/070,411

(22) Filed: Oct. 14, 2020

(65) Prior Publication Data

US 2021/0050206 A1 Feb. 18, 2021

Related U.S. Application Data

(63) Continuation of application No. 15/769,998, filed as application No. PCT/US2016/058132 on Oct. 21, 2016, now Pat. No. 11,120,984.

(Continued)

(51) Int. Cl.
*H01J 49/00* (2006.01)
*H01J 49/42* (2006.01)

(52) U.S. Cl.
CPC ..... *H01J 49/426* (2013.01); *H01J 49/0031* (2013.01); *H01J 49/422* (2013.01); *H01J 49/427* (2013.01); *H01J 49/4285* (2013.01)

(58) Field of Classification Search
CPC ..... H01J 49/422; H01J 49/426; H01J 49/427; H01J 49/429; H01J 49/4285; H01J 49/0031
See application file for complete search history.

(56) References Cited

U.S. PATENT DOCUMENTS 5,644,131 A 7/1997 Hansen
5,679,950 A 10/1997 Baba et al.
(Continued)

FOREIGN PATENT DOCUMENTS

WO 2009/023361 A3 5/2009
WO 2009/102766 A1 8/2009

OTHER PUBLICATIONS

Evans-Nguyen, Theresa, et al. "Development of a low power, high mass range mass spectrometer for Mars surface analysis." International Journal of Mass Spectrometry 278.2-3 (2008): 170-177 (Year: 2008).*

(Continued)

*Primary Examiner* — Wyatt A Stoffa
(74) *Attorney, Agent, or Firm* — Brown Rudnick LLP; Adam M. Schoen

(57) ABSTRACT

The invention generally relates to ion traps and methods of use thereof. In certain embodiments, the invention provides a system that includes a mass spectrometer including an ion trap, and a central processing unit (CPU). The CPU has storage that is coupled to the CPU for storing instructions that when executed by the CPU cause the system to apply a constant radio frequency (RF) signal to the ion trap, and apply a first alternating current (AC) signal to the ion trap the frequency of which varies as a function of time.

16 Claims, 7 Drawing Sheets

Related U.S. Application Data

(60) Provisional application No. 62/245,438, filed on Oct. 23, 2015.

(56) References Cited

U.S. PATENT DOCUMENTS

| | | | | |
|---|---|---|---|---|
| 6,838,666 | B2 | 1/2005 | Ouyang et al. | |
| 7,335,897 | B2 | 2/2008 | Takats et al. | |
| 7,947,948 | B2 * | 5/2011 | Schwartz | H01J 49/423 250/283 |
| 8,304,718 | B2 | 11/2012 | Ouyang et al. | |
| 9,157,921 | B2 | 10/2015 | Cooks et al. | |
| 9,396,923 | B2 * | 7/2016 | Kodera | H01J 49/424 |
| 11,120,984 | B2 * | 9/2021 | Cooks | H01J 49/4285 |
| 2009/0090860 | A1 * | 4/2009 | Furuhashi | H01J 49/427 250/283 |
| 2010/0320377 | A1 * | 12/2010 | Cotter | H01J 49/424 250/283 |
| 2012/0119079 | A1 | 5/2012 | Ouyang et al. | |
| 2013/0273560 | A1 | 10/2013 | Cooks et al. | |
| 2014/0231643 | A1 | 8/2014 | Ouyang et al. | |
| 2014/0252224 | A1 | 9/2014 | Rafferty et al. | |
| 2015/0097115 | A1 * | 4/2015 | Schwartz | H01J 49/424 250/283 |
| 2015/0160232 | A1 * | 6/2015 | Chen | G01N 33/6851 250/282 |
| 2015/0255263 | A1 * | 9/2015 | Kodera | H01J 49/424 250/283 |
| 2015/0255265 | A1 | 9/2015 | Xu et al. | |
| 2017/0018418 | A1 * | 1/2017 | Ermakov | H01J 49/4245 |

OTHER PUBLICATIONS

Austin, 2007, Halo Ion Trap Mass Spectrometer, Anal. Chem., 79:2927-2932.

Blain, 2004, Towards the Hand-Held Mass Spectrometer: Design Considerations, Simulation and Fabrication of Micrometer-scaled Cylindrical Ion Traps, Int. J. Mass Spectrom., 236:91-104.

Bonner, 1977, The Cylindrical Ion Trap, International Journal of Mass Spectrometry and Ion Physics, 24(3):255-269.

Carroll, 1975, Atmospheric Pressure Ionization Mass Spectrometry: Corona Discharge Ion Source for Use in Liquid Chromatograph-Mass Spectrometer-Computer Analytical System, Anal. Chem. 47:2369-2373.

Cody, 2005, Versatile New Ion Source for the Analysis of Materials in Open Air under Ambient Condition, Anal. Chem., 77:2297-2302.

Fenn, 1989, Electrospray Ionization for Mass Spectrometry of Large Biomolecules, Science 246:64-71.

Gao, 2008, Design anc Characterization of a Multisource Hand-Held Tandem Mass Spectrometer, Z. Anal. Chem, 80:7198-7205.

Hagar, 2002, A new linear ion trap mass spectromer, Rapid Communi. Mass Spectrometry, 16(6):512-526.

Hou, 2011, Sampling Wand for an Ion Trap Mass Spectrometer, Anal. Chem., 83:1857-1861.

Kogelschatz, 2003, Dielectric-barrier Discharges: Their History, Discharge Physics, and Industrial Applications, Plasma Chem. and Plasma Processing, 23:1-46.

Laiko, 2000, Atmospheric Pressure Matrix-Assisted Laser Desoprtion/Ionization Mass Spectrometry, Analytical Chemistry, 72:652-657.

Li, 2014, Miniature Ambient Mass Analysis System, Anal. Chem., 86:2909-2916.

Paul, 2014, Autonomous in Situ analysis and Real-Time Chemical Detection Using a Backpack Miniature Mass SPectrometer: concept, Instrumentation Development, and Performance, Anal. Chem., 86:2900-2908.

Shiea, 2005, Electrospray-assisted laser desorption/ionization mass spectrometry for direct ambient analysis of solids, J. Rapid Commun. Mass Spectrom., 19:3701-3704.

Sokol, 2011, Miniature mass spectrometer equipped with electrospray and desorption electrospray ionization for direct analysis of organics from solids and solutions, Int. J. Mass Spectrum. 306:187-195.

Takats, 2004, Mass Spectrometry Sampling Under Ambient Conditions with Desoprtion Electrospray Ionization, Science 306:471-473.

Tanaka, 1988, Protein and Polymer Analyses up to m/z 1000000 by Laser Ionization Time-of-flight Mass Spectrometry, Rapid Commun. Mass Spectrom., vol. 2: pp. 151-153.

Yamashita, 1984, Electrospray Ion Source. Another Variation on the Free-Jet Theme, J. Phys. Chem., 88:4451-4459.

* cited by examiner

ION TRAPS THAT APPLY AN INVERSE MATHIEU Q SCAN

RELATED APPLICATION

The present application is a continuation of U.S. application Ser. No. 15/769,998, filed Apr. 20, 2019, which is a 35 U.S.C. § 371 national phase application of PCT/US16/58132, filed Oct. 21, 2016, which claims the benefit of and priority to U.S. provisional application Ser. No. 62/245,438, filed Oct. 23, 2015, the content of each of which is incorporated by reference herein in its entirety.

GOVERNMENT INTEREST

This invention was made with government support under CHE 1307264 awarded by the National Science Foundation (NSF). The government has certain rights in the invention.

FIELD OF THE INVENTION

The invention generally relates to ion traps and methods of use thereof.

BACKGROUND

Quadrupole ion traps are one of the main types of mass analyzers employed in mass spectrometers. They are compact devices that are relatively inexpensive and they provide mass spectra with adequate resolution to separate ions differing by 1 Da in mass at unit charge. Those systems are capable of high sensitivity and importantly a single mass analyzer can be used for multiple stage (tandem or MS/MS) experiments to increase specificity of identification.

Commercial mass spectrometers are based on mass-selective instability. In the mass-selective instability method, ions of a range of different mass/charge ratios (m/z) are trapped in the quadrupolar field (in either two or three directions, 2D or 3D) through application of a radio frequency (RF) signal of relatively high amplitude (ca. 5 kV) and frequency (ca. 1 MHz). Ions of particular m/z values can be made unstable and hence detectable by an external ion detector by increasing the RF amplitude so that they acquire unstable trajectories and leave the trap. By scanning the RF amplitude ($V_{RF}$) to higher values, ions of increasing mass become unstable and a mass spectrum can be recorded displaying the abundances of ejected ions in order of their m/z values. Alternatively, the frequency ($\Omega_{RF}$) of the applied RF can be scanned to cause mass-selective instability to allow a mass spectrum to be recorded. Those scans are based on the relationship between ion stability, expressed in terms of Mathieu parameters, a and q, and m/z, $V_{RF}$, $\Omega_{RF}$, and the applied DC potential U, and the internal dimensions of the device ($r_0$, or x, y and z). In one mode of operation, performed without application of a DC potential (U), the mass analysis equation is defined by Equation 1 below.

$$m/z=8V_{RF}/[0.908(r_0^2+2z_0^2)\Omega_{RF}^2] \quad \text{Equation 1}$$

In standard practice, ions are not ejected by crossing the boundary of the stability diagram as Equation 1 implies. Instead, an additional supplementary alternating current (AC; "supplementary AC") signal is applied so as to set up an approximately dipolar field. If the frequency of this AC signal matches a resonance frequency of ions of a given m/z value, then those ions will acquire energy, and if the time of application and the amplitude of the signal is appropriate, they will leave the ion trap. In order to record a mass spectrum, $V_{RF}$ is scanned while the AC signal is applied at a set frequency. That brings ions of successive mass/charge ratios into resonance with this AC signal and causes their ejection. In the case of the halotrap, a scan of the AC frequency at constant $V_{RF}$ has been used to record a mass spectrum. [Austin, D. E.; Wang, M.; Tolley, S. E.; Maas, J. D.; Hawkins, A. R.; Rockwood, A. L.; Tolley, H. D.; Lee, E. D.; Lee, M. L. Anal. Chem. 2007, 79, 2927]

Quadrupole mass filters use 2D quadrupole fields and operate with applied RF and DC potentials set so that ions of a small range of mass/charge values occupy a region of stability in the Mathieu stability diagram near the apex of the first stability region in a, q space. In the normal mode of operation, ions are continuously supplied to the device such that they are subjected to a 2D quadrupole field in a direction orthogonal to their drift motion. Conditions of mass-selective stability are set up using values of the amplitudes of the applied RF and DC voltages so that ions with a range of m/z values pass through the device and are detected, the width of this stability window depending on the exact ratio of $V_{RF}$ and U chosen. Then, in order to scan a mass spectrum, the amplitudes of both $V_{RF}$ and U are scanned in a fixed ratio so that ions of different mass/charge ratios are brought to the stability condition as a function of time.

SUMMARY

The invention recognizes that operating an ion trap in which the RF signal (amplitude or frequency) needs to be varied in a precise manner over time requires complicated electronics. The invention provides mass spectrometry systems in which an ion trap is operated with a constant RF signal and a varied AC signal (varied supplementary AC signal). An advantage of such a scan over conventional scanning methods is that the high voltage and high frequency parameters, $V_{RF}$ and $\Omega_{RF}$, can be kept constant, greatly simplifying the electronics requirements that are involved in scanning one or other of those parameters in a highly precise way over time. The scan mode of the invention is particularly well suited for use in miniature mass spectrometers because simplified less expensive electronics are especially desirable in the cost, weight and power constrained system of a miniature mass spectrometer.

In certain aspects, the invention provides a system that includes a mass spectrometer including an ion trap, and a central processing unit (CPU). The CPU has storage that is coupled to the CPU for storing instructions that when executed by the CPU cause the system to apply a constant radio frequency (RF) signal to the ion trap, and apply an alternating current (AC) signal to the ion trap, the frequency of which varies as a function of time. The instructions, when executed by the CPU can further cause the system to vary the amplitude of the AC signal as a function of time. In certain embodiments, the AC signal is in resonance with a secular frequency of ions trapped within the ion trap.

Mass spectrometers in systems of the invention typically include one or more detectors. In certain embodiments, the mass spectrometer includes a single detector that is positioned to receive ion orthogonally or axially ejected from the ion trap. In preferred embodiments, the detector is positioned to receive ion orthogonally ejected from the ion trap. In other embodiments, the mass spectrometer includes two detectors, a first detector that is positioned in-line with the ion trap such that stable ions that pass through the ion trap are received at the first detector, and a second detector that is positioned orthogonal to the ion trap such that unstable ions ejected from the ion trap are received at the second detector.

Any ion trap can be used in systems of the invention. Exemplary ion traps include a hyperbolic ion trap (e.g., U.S. Pat. No. 5,644,131, the content of which is incorporated by reference herein in its entirety), a cylindrical ion trap (e.g., Bonner et al., International Journal of Mass Spectrometry and Ion Physics, 24(3):255-269, 1977, the content of which is incorporated by reference herein in its entirety), a linear ion trap (Hagar, Rapid Communications in Mass Spectrometry, 16(6):512-526, 2002, the content of which is incorporated by reference herein in its entirety), and a rectilinear ion trap (U.S. Pat. No. 6,838,666, the content of which is incorporated by reference herein in its entirety).

Any mass spectrometer (e.g., bench-top or miniature mass spectrometer) may be used in systems of the invention. In certain embodiments, the mass spectrometer is a miniature mass spectrometer. In certain embodiments, the systems of the invention include an ionizing source, which can be any type of ionizing source known in the art. In certain embodiments, the systems of the invention include a discontinuous interface, such as described for example in U.S. Pat. No. 8,304,718, the content of which is incorporated by reference herein in its entirety.

In other aspects, the invention provides methods for operating an ion trap of a mass spectrometer. Those methods involve applying a constant radio frequency (RF) signal to an ion trap of a mass spectrometer, and applying an alternating current (AC) signal to the ion trap that varies as a function of time. In certain embodiments, a frequency of the AC signal varies as a function of time. In other embodiments, an amplitude of the AC signal varies as a function of time. In other embodiments, both the frequency and amplitude of the AC signal vary as a function of time. The AC signal may be in resonance with a secular frequency of ions trapped within the ion trap. In certain embodiments, ions are discontinuously introduced into the ion trap.

Methods of the invention may additionally involve detecting ions ejected from the ion trap resulting from application of the AC signal to the ion trap. In an exemplary embodiment, a first detector of the mass spectrometer is positioned orthogonal with the ion trap such that unstable ions are ejected from the ion trap and are received at the first detector. In other embodiments, a first detector of the mass spectrometer is positioned in-line with the ion trap such that stable ions that pass through the ion trap are received at the first detector, and a second detector of the mass spectrometer is positioned orthogonal to the ion trap such that unstable ions ejected from the ion are received at the second detector.

In certain embodiments a scan of AC allows ions of a narrow range of selected masses to be transmitted and seen at an in-line detector due to the scan bringing different ions to the detector.

Another aspect of the invention provides methods for analyzing a sample. The methods involve ionizing a sample to generate sample ions that are introduced into an ion trap of a mass spectrometer. A radio frequency (RF) signal and an alternating current (AC) signal are applied to the ion trap of a mass spectrometer. The RF signal is held constant and the AC signal varies as a function of time. Varying the AC signal causes instability in the sample ions in the ion trap. Unstable ions are ejected from the ion trap and received at a detector where the sample ions are analyzed.

In certain embodiments, a frequency of the AC signal varies as a function of time. In other embodiments, an amplitude of the AC signal varies as a function of time. In other embodiments, both the frequency and amplitude of the AC signal vary as a function of time. The AC signal may be in resonance with a secular frequency of ions trapped within the ion trap. In certain embodiments, ions are discontinuously introduced into the ion trap.

The sample may be any sample, such as a biological sample, an industrial sample, an environmental sample, or an agricultural sample. In the case of biological samples, a disease may be diagnosed based on the results of the analysis.

DETAILED DESCRIPTION

Figure 1:
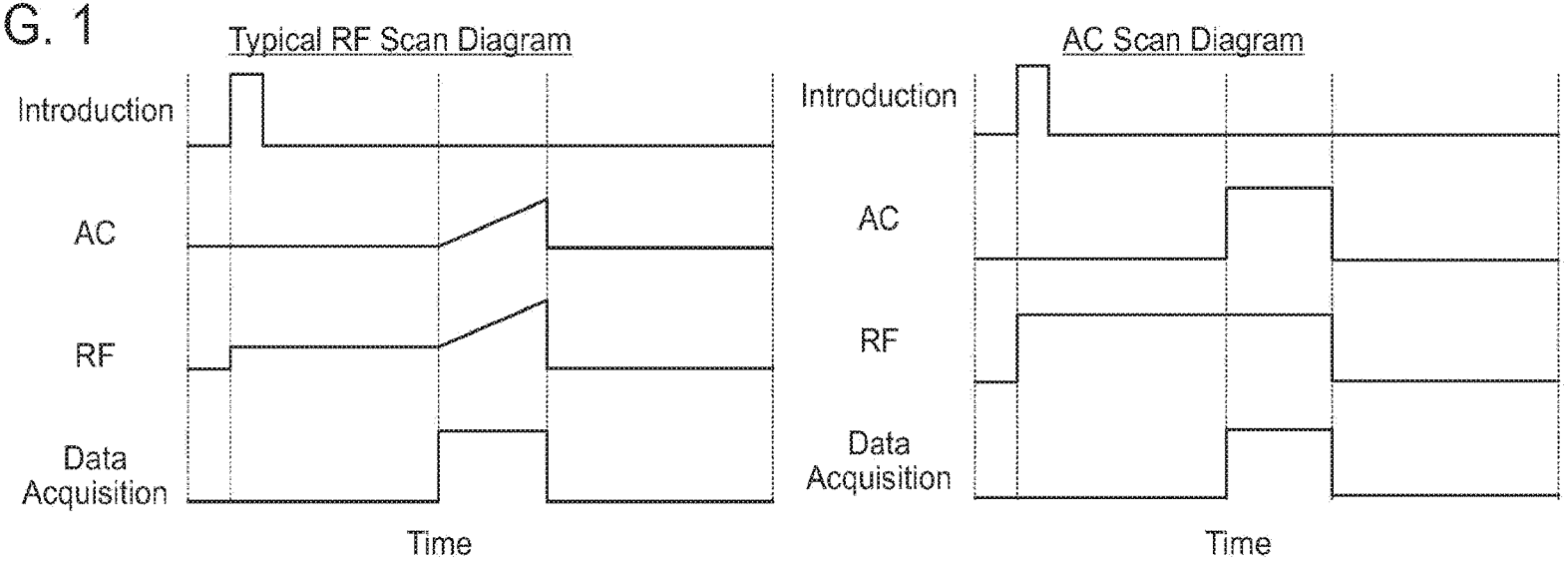
FIG. 1 is a set of timing diagram showing voltages that are scanned in a typical RF mass-selective instability scan and in the new AC frequency scan in the case of a cylindrical geometry quadrupole ion trap.

The invention generally relates to ion traps and methods of use thereof In certain embodiments, the invention provides a system that includes a mass spectrometer including an ion trap, and a central processing unit (CPU). The CPU has storage that is coupled to the CPU for storing instructions that when executed by the CPU cause the system to apply a constant radio frequency (RF) signal to the ion trap, and apply an alternating current (AC) signal to the ion trap, that varies as a function of time, e.g., is continuously varied as a function of time. Either or both of a frequency and an amplitude of the AC signal can be varied as a function of time.

In certain embodiments, as applied to the ion trap, the frequency ($\omega_{ac}$) of the AC signal (e.g., supplementary AC signal) is scanned, while $V_{RF}$ and $\Omega_{RF}$ are kept constant. The amplitude of the AC signal may be scanned too but that is not required. The scan of $\omega_{ac}$ produces a mass spectrum. An advantage of such a scan over conventional scanning methods is that the high voltage and high frequency parameters, $V_{RF}$ and $\Omega_{RF}$, can be kept constant, greatly simplifying the electronics requirements that are involved in scanning one or other of these parameters in a highly precise way over time. In ion traps of conventional size, $V_{AC}$ is just a few volts and the frequency $\omega_{ac}$, is in the kHz range. These parameters, especially the low voltage, plus the ease with which frequencies can be scanned make this a simple and attractive scan mode. The skilled artisan will know how to select values of $\omega_{ac}$. This capability is used so that ions of particular m/z values (or a window of m/z values, or several ions of different m/z values) can be selected and activated so as to be ejected from the trap (without being mass measured) to allow the remaining ions to be used as precursor ions in product ion MS/MS experiments. Alternatively, the ions of selected m/z values or ranges can be activated without ejection to cause them to undergo collisional fragmentation to generate the product ions that are observed in a subsequent $V_{RF}$ or AC frequency scan that generates a product ion MS/MS spectrum.

Any ion trap known in the art can be used in systems of the invention. Exemplary ion traps include a hyperbolic ion trap, a cylindrical ion trap, a linear ion trap, a rectilinear ion trap, or a quadrupole ion trap. In certain embodiments, the properties of the main trapping field established by the operating parameters $V_{RF}$ and U are selected so as to trap the ions within the ion trap. During that operation, a supplementary AC signal of relatively low amplitude can be applied to cause the ions to become unstable. That instability results in the ions being ejected, orthogonally or axially, from the ion trap in order of ascending m/z ratio. The ejected ions impinge on a detector, and a mass spectrum is recorded.

In other embodiments, the properties of the main trapping field established by the operating parameters $V_{RF}$ and U are selected so as to allow a relatively wide range of m/z values of ions to have stable trajectories and drift through the device to an in-line detector. During that operation, a supplementary AC signal of relatively low amplitude can be applied to set up a dipolar field at a frequency which is in resonance with the secular or other characteristic frequency of motion of ions a particular m/z value. Depending on whether this signal is applied in the x- or the y-direction, the resonant ions will acquire kinetic energy and become unstable (cross the x- or y-stability boundary in the Mathieu stability diagram) and be lost to the electrode structure or ejected into a second orthogonal detector. By scanning the frequency of the supplementary AC signal, ions of different m/z values will be made unstable and a mass spectrum is recorded. Note that a mass spectrum can also be recorded by observing the loss of signal at the in-line detector.

The proposed scan mode is particularly well suited to use in miniature mass spectrometers because simplified less expensive electronics is highly desirable in the cost, weight and power constrained system of a miniature mass spectrometer. In fact, achieving linear scans of $V_{RF}$ is a major contributor to the complexity of the electronics systems of miniature ion traps. See Paul et al. (Anal. Chem., 2014, 86 2900-2908 DOI: 10.1021/ac403765x) and Li et al. Anal. Chem. 2014, 86 2909-2916, DOI: 10.1021/ac403766c). It is much easier to set a fixed frequency MHz trapping signal in the kV range and scan a few volt kHz signal than it is to perform the normal mass selective instability scan with a varying $V_{RF}$ or even with a varying $\Omega_{RF}$. That is, scanning the frequency of a 10 v signal is easier than scanning the frequency of a kV signal.

Such a manner of operating a mass spectrometer allows for miniaturization to the point that it possible to fabricate a cell phone mass spectrometer for gas and vapor analysis. Details of miniaturization are provided in Blain et al., (Int. J. Mass Spectrom. 236 (2004) 91-104), the content of which is incorporated by reference herein in its entirety.

Besides the simplification of the electronics, the high physical tolerances that are required in quadrupole mass filters (as opposed to quadrupole ion traps) are relaxed when using the supplementary AC frequency scan. That is best seen in simulations of ion motion that show that the tight control of a, q values needed to achieve useful mass resolution in the normal mass selective stability mode of operation means that ions that are stable occupy regions of space close to the electrodes many times in their passage through the filter. By contrast, in the AC frequency scan mode, this is not the case. Simpler cheaper devices can therefore be used.

Any mass spectrometer may be used in systems of the invention and in certain embodiments, the mass spectrometer is a miniature mass spectrometer. An exemplary miniature mass spectrometer is described, for example in Gao et al. (Z. Anal. Chem. 2008, 80, 7198-7205), the content of which is incorporated by reference herein in its entirety. In comparison with the pumping system used for lab-scale instruments with thousands watts of power, miniature mass spectrometers generally have smaller pumping systems, such as a 18 W pumping system with only a 5 L/min (0.3 m3/hr) diaphragm pump and a 11 L/s turbo pump for the system described in Gao et al. Other exemplary miniature mass spectrometers are described for example in Gao et al. (Anal. Chem., 2006, 80:7198-7205, 2008), Hou et al. (Anal. Chem., 83:1857-1861, 2011), and Sokol et al. (Int. J. Mass Spectrom., 2011, 306, 187-195), the content of each of which is incorporated herein by reference in its entirety.

In certain embodiments, the systems of the invention include an ionizing source, which can be any type of ionizing source known in the art. Exemplary mass spectrometry techniques that utilize ionization sources at atmospheric pressure for mass spectrometry include PAPER SPRAY ionization (ionization using wetted porous material, Ouyang et al., U.S. patent application publication number 2012/0119079), electrospray ionization (ESI; Fenn et al., Science, 246:64-71, 1989; and Yamashita et al., J. Phys. Chem., 88:4451-4459, 1984); atmospheric pressure ionization (APCI; Carroll et al., Anal. Chem. 47:2369-2373, 1975); and atmospheric pressure matrix assisted laser desorption ionization (AP-MALDI; Laiko et al. Anal. Chem., 72:652-657, 2000; and Tanaka et al. Rapid Commun. Mass Spectrom., 2:151-153, 1988). The content of each of these references in incorporated by reference herein its entirety.

Exemplary mass spectrometry techniques that utilize direct ambient ionization/sampling methods including desorption electrospray ionization (DESI; Takats et al., Science, 306:471-473, 2004 and U.S. Pat. No. 7,335,897); direct analysis in real time (DART; Cody et al., Anal. Chem., 77:2297-2302, 2005); Atmospheric Pressure Dielectric Barrier Discharge Ionization (DBDI; Kogelschatz, Plasma Chemistry and Plasma Processing, 23:1-46, 2003, and PCT international publication number WO 2009/102766), and electrospray-assisted laser desoption/ionization (ELDI; Shiea et al., J. Rapid Communications in Mass Spectrometry, 19:3701-3704, 2005). The content of each of these references in incorporated by reference herein its entirety.

Aspects of the invention described herein can be performed using any type of computing device, such as a computer, that includes a processor, e.g., a central processing unit, or any combination of computing devices where each device performs at least part of the process or method. In some embodiments, systems and methods described herein may be performed with a handheld device, e.g., a smart tablet, or a smart phone, or a specialty device produced for the system. The computing device is operably coupled to a mass spectrometer.

Methods of the invention can be performed using software, hardware, firmware, hardwiring, or combinations of any of these. Features implementing functions can also be physically located at various positions, including being distributed such that portions of functions are implemented at different physical locations (e.g., imaging apparatus in one room and host workstation in another, or in separate buildings, for example, with wireless or wired connections).

Processors suitable for the execution of computer program include, by way of example, both general and special purpose microprocessors, and any one or more processor of any kind of digital computer. Generally, a processor will receive instructions and data from a read-only memory or a random access memory or both. The essential elements of computer are a processor for executing instructions and one or more memory devices for storing instructions and data. Generally, a computer will also include, or be operatively coupled to receive data from or transfer data to, or both, one or more mass storage devices for storing data, e.g., magnetic, magneto-optical disks, or optical disks. Information carriers suitable for embodying computer program instructions and data include all forms of non-volatile memory, including by way of example semiconductor memory devices, (e.g., EPROM, EEPROM, solid state drive (SSD), and flash memory devices); magnetic disks, (e.g., internal hard disks or removable disks); magneto-optical disks; and optical disks (e.g., CD and DVD disks). The processor and the memory can be supplemented by, or incorporated in, special purpose logic circuitry.

To provide for interaction with a user, the subject matter described herein can be implemented on a computer having an I/O device, e.g., a CRT, LCD, LED, or projection device for displaying information to the user and an input or output device such as a keyboard and a pointing device, (e.g., a mouse or a trackball), by which the user can provide input to the computer. Other kinds of devices can be used to provide for interaction with a user as well. For example, feedback provided to the user can be any form of sensory feedback, (e.g., visual feedback, auditory feedback, or tactile feedback), and input from the user can be received in any form, including acoustic, speech, or tactile input.

The subject matter described herein can be implemented in a computing system that includes a back-end component (e.g., a data server), a middleware component (e.g., an application server), or a front-end component (e.g., a client computer having a graphical user interface or a web browser through which a user can interact with an implementation of the subject matter described herein), or any combination of such back-end, middleware, and front-end components. The components of the system can be interconnected through network by any form or medium of digital data communication, e.g., a communication network. For example, the reference set of data may be stored at a remote location and the computer communicates across a network to access the reference set to compare data derived from the female subject to the reference set. In other embodiments, however, the reference set is stored locally within the computer and the computer accesses the reference set within the CPU to compare subject data to the reference set. Examples of communication networks include cell network (e.g., 3G or 4G), a local area network (LAN), and a wide area network (WAN), e.g., the Internet.

The subject matter described herein can be implemented as one or more computer program products, such as one or more computer programs tangibly embodied in an information carrier (e.g., in a non-transitory computer-readable medium) for execution by, or to control the operation of, data processing apparatus (e.g., a programmable processor, a computer, or multiple computers). A computer program (also known as a program, software, software application, app, macro, or code) can be written in any form of programming language, including compiled or interpreted languages (e.g., C, C++, Perl), and it can be deployed in any form, including as a stand-alone program or as a module, component, subroutine, or other unit suitable for use in a computing environment. Systems and methods of the invention can include instructions written in any suitable programming language known in the art, including, without limitation, C, C++, Perl, Java, ActiveX, HTML5, Visual Basic, or JavaScript.

A computer program does not necessarily correspond to a file. A program can be stored in a file or a portion of file that holds other programs or data, in a single file dedicated to the program in question, or in multiple coordinated files (e.g., files that store one or more modules, sub-programs, or portions of code). A computer program can be deployed to be executed on one computer or on multiple computers at one site or distributed across multiple sites and interconnected by a communication network.

A file can be a digital file, for example, stored on a hard drive, SSD, CD, or other tangible, non-transitory medium. A file can be sent from one device to another over a network (e.g., as packets being sent from a server to a client, for example, through a Network Interface Card, modem, wireless card, or similar).

Writing a file according to the invention involves transforming a tangible, non-transitory computer-readable medium, for example, by adding, removing, or rearranging particles (e.g., with a net charge or dipole moment into patterns of magnetization by read/write heads), the patterns then representing new collocations of information about objective physical phenomena desired by, and useful to, the user. In some embodiments, writing involves a physical transformation of material in tangible, non-transitory computer readable media (e.g., with certain optical properties so that optical read/write devices can then read the new and useful collocation of information, e.g., burning a CD-ROM). In some embodiments, writing a file includes transforming a physical flash memory apparatus such as NAND flash memory device and storing information by transforming physical elements in an array of memory cells made from floating-gate transistors. Methods of writing a file are well-known in the art and, for example, can be invoked manually or automatically by a program or by a save command from software or a write command from a programming language.

Suitable computing devices typically include mass memory, at least one graphical user interface, at least one display device, and typically include communication between devices. The mass memory illustrates a type of computer-readable media, namely computer storage media. Computer storage media may include volatile, nonvolatile, removable, and non-removable media implemented in any method or technology for storage of information, such as computer readable instructions, data structures, program modules, or other data. Examples of computer storage media include RAM, ROM, EEPROM, flash memory, or other memory technology, CD-ROM, digital versatile disks (DVD) or other optical storage, magnetic cassettes, magnetic tape, magnetic disk storage or other magnetic storage devices, Radiofrequency Identification tags or chips, or any other medium which can be used to store the desired information and which can be accessed by a computing device.

As one skilled in the art would recognize as necessary or best-suited for performance of the methods of the invention, a computer system or machines of the invention include one or more processors (e.g., a central processing unit (CPU) a graphics processing unit (GPU) or both), a main memory and a static memory, which communicate with each other via a bus.

Figure 8:
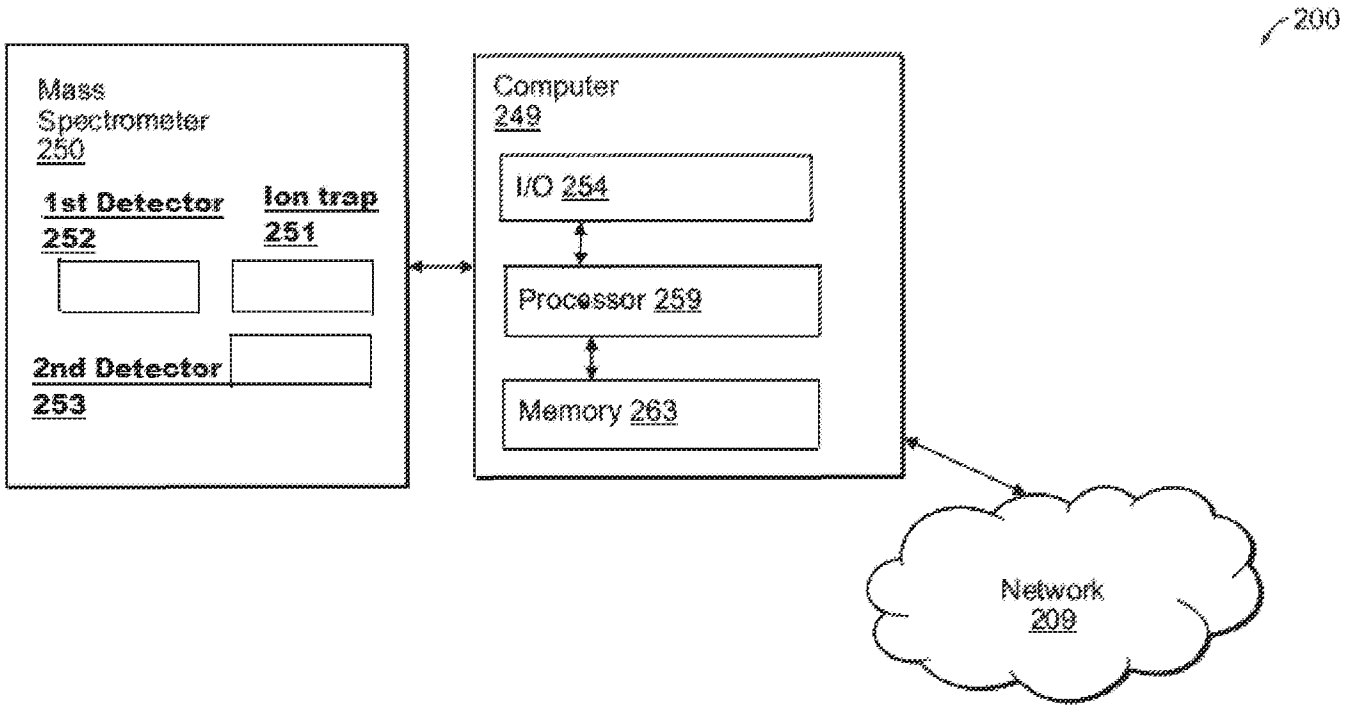
FIG. 8 shows a diagram of an embodiment of a system of the invention.

In an exemplary embodiment shown in FIG. 8, system 200 can include a computer 249 (e.g., laptop, desktop, or tablet). The computer 249 may be configured to communicate across a network 209. Computer 249 includes one or more processor 259 and memory 263 as well as an input/output mechanism 254. The computer 249 is operably connected to a mass spectrometer 250, through standard hardware connections. In the exemplary embodiment shown in FIG. 8, the mass spectrometer 250 includes ion trap 251, first detector 252, and second detector 253. The skilled artisan will appreciate that this set-up is exemplary and that other set-ups are within the scope of the invention. For example, a second detector is not required. Additionally, the arrangement of the one or more detectors as orthogonal and in-line is exemplary and other arrangements are within the scope of the invention.

System 200 or machines according to the invention may further include for I/O 249 a video display unit (e.g., a liquid crystal display (LCD) or a cathode ray tube (CRT)). Computer systems or machines according to the invention can also include an alphanumeric input device (e.g., a keyboard), a cursor control device (e.g., a mouse), a disk drive unit, a signal generation device (e.g., a speaker), a touchscreen, an accelerometer, a microphone, a cellular radio frequency antenna, and a network interface device, which can be, for example, a network interface card (NIC), Wi-Fi card, or cellular modem.

Memory 263 according to the invention can include a machine-readable medium on which is stored one or more sets of instructions (e.g., software) embodying any one or more of the methodologies or functions described herein. The software may also reside, completely or at least partially, within the main memory and/or within the processor during execution thereof by the computer system, the main memory and the processor also constituting machine-readable media. The software may further be transmitted or received over a network via the network interface device.

Sample Analysis

Another aspect of the invention provides methods for analyzing a sample using mass spectrometry systems that include ion traps of the invention. The methods involve ionizing a sample to generate sample ions that are introduced into an ion trap of a mass spectrometer. Any of the ionization techniques described herein can be used to ionize the sample. The ion trap is then operated as discussed herein. That is, a radio frequency (RF) signal and an alternating current (AC) signal are applied to the ion trap of the mass spectrometer. The RF signal is held constant and the AC signal varies as a function of time. Varying the AC signal causes instability in the sample ions in the ion trap. Unstable ions are ejected from the ion trap and received at a detector where the sample ions are analyzed. Typically, a mass spectrum is produced or mass spectra are produced and they are analyzed. The analysis can be comparing the sample spectrum against a reference spectrum or by simply analyzing the spectrum for the presence of certain peaks that are indicative of certain analytes in the sample. Exemplary analysis methods are shown for example in U.S. Pat. No. 9,157,921 and U.S. patent application publication number 2013/0273560, the content of each of which is incorporated by reference herein in its entirety.

A wide range of heterogeneous samples can be analyzed, such as biological samples, environmental samples (including, e.g., industrial samples and agricultural samples), and food/beverage product samples, etc.

Exemplary environmental samples include, but are not limited to, groundwater, surface water, saturated soil water, unsaturated soil water; industrialized processes such as waste water, cooling water; chemicals used in a process, chemical reactions in an industrial processes, and other systems that would involve leachate from waste sites; waste and water injection processes; liquids in or leak detection around storage tanks; discharge water from industrial facilities, water treatment plants or facilities; drainage and leachates from agricultural lands, drainage from urban land uses such as surface, subsurface, and sewer systems; waters from waste treatment technologies; and drainage from mineral extraction or other processes that extract natural resources such as oil production and in situ energy production.

Additionally exemplary environmental samples include, but certainly are not limited to, agricultural samples such as crop samples, such as grain and forage products, such as soybeans, wheat, and corn. Often, data on the constituents of the products, such as moisture, protein, oil, starch, amino acids, extractable starch, density, test weight, digestibility, cell wall content, and any other constituents or properties that are of commercial value is desired.

Exemplary biological samples include a human tissue or bodily fluid and may be collected in any clinically acceptable manner. A tissue is a mass of connected cells and/or extracellular matrix material, e.g. skin tissue, hair, nails, nasal passage tissue, CNS tissue, neural tissue, eye tissue, liver tissue, kidney tissue, placental tissue, mammary gland tissue, placental tissue, mammary gland tissue, gastrointestinal tissue, musculoskeletal tissue, genitourinary tissue, bone marrow, and the like, derived from, for example, a human or other mammal and includes the connecting material and the liquid material in association with the cells and/or tissues. A body fluid is a liquid material derived from, for example, a human or other mammal. Such body fluids include, but are not limited to, mucous, blood, plasma, serum, serum derivatives, bile, blood, maternal blood, phlegm, saliva, sputum, sweat, amniotic fluid, menstrual fluid, mammary fluid, peritoneal fluid, urine, semen, and cerebrospinal fluid (CSF), such as lumbar or ventricular CSF. A sample may also be a fine needle aspirate or biopsied tissue. A sample also may be media containing cells or biological material. A sample may also be a blood clot, for example, a blood clot that has been obtained from whole blood after the serum has been removed.

In one embodiment, the biological sample can be a blood sample, from which plasma or serum can be extracted. The blood can be obtained by standard phlebotomy procedures and then separated. Typical separation methods for preparing a plasma sample include centrifugation of the blood sample. For example, immediately following blood draw, protease inhibitors and/or anticoagulants can be added to the blood sample. The tube is then cooled and centrifuged, and can subsequently be placed on ice. The resultant sample is separated into the following components: a clear solution of blood plasma in the upper phase; the buffy coat, which is a thin layer of leukocytes mixed with platelets; and erythrocytes (red blood cells). Typically, 8.5 mL of whole blood will yield about 2.5-3.0 mL of plasma.

Blood serum is prepared in a very similar fashion. Venous blood is collected, followed by mixing of protease inhibitors and coagulant with the blood by inversion. The blood is allowed to clot by standing tubes vertically at room temperature. The blood is then centrifuged, wherein the resultant supernatant is the designated serum. The serum sample should subsequently be placed on ice.

Prior to analyzing a sample, the sample may be purified, for example, using filtration or centrifugation. These techniques can be used, for example, to remove particulates and chemical interference. Various filtration media for removal of particles includes filer paper, such as cellulose and membrane filters, such as regenerated cellulose, cellulose acetate, nylon, PTFE, polypropylene, polyester, polyethersulfone, polycarbonate, and polyvinylpyrolidone. Various filtration media for removal of particulates and matrix interferences includes functionalized membranes, such as ion exchange membranes and affinity membranes; SPE cartridges such as silica- and polymer-based cartridges; and SPE (solid phase extraction) disks, such as PTFE- and fiberglass-based. Some of these filters can be provided in a disk format for loosely placing in filter holdings/housings, others are provided within a disposable tip that can be placed on, for example, standard blood collection tubes, and still others are provided in the form of an array with wells for receiving pipetted samples. Another type of filter includes spin filters. Spin filters consist of polypropylene centrifuge tubes with cellulose acetate filter membranes and are used in conjunction with centrifugation to remove particulates from samples, such as serum and plasma samples, typically diluted in aqueous buffers.

Filtration is affected in part, by porosity values, such that larger porosities filter out only the larger particulates and smaller porosities filtering out both smaller and larger porosities. Typical porosity values for sample filtration are the 0.20 and 0.45 μm porosities. Samples containing colloidal material or a large amount of fine particulates, considerable pressure may be required to force the liquid sample through the filter. Accordingly, for samples such as soil extracts or wastewater, a prefilter or depth filter bed (e.g. "2-in-1" filter) can be used and which is placed on top of the membrane to prevent plugging with samples containing these types of particulates.

In some cases, centrifugation without filters can be used to remove particulates, as is often done with urine samples. For example, the samples are centrifuged. The resultant supernatant is then removed and frozen.

After a sample has been obtained and purified, the sample can be analyzed to determine the concentration of one or more target analytes, such as elements within a blood plasma sample. With respect to the analysis of a blood plasma sample, there are many elements present in the plasma, such as proteins (e.g., Albumin), ions and metals (e.g., iron), vitamins, hormones, and other elements (e.g., bilirubin and uric acid). Any of these elements may be detected using methods of the invention. More particularly, methods of the invention can be used to detect molecules in a biological sample that are indicative of a disease state.

Discontinuous Atmospheric Pressure Interface (DAPI)

In certain embodiments, the systems of the invention can be operated with a Discontinuous Atmospheric Pressure Interface (DAPI). A DAPI is particularly useful when coupled to a miniature mass spectrometer, but can also be used with a standard bench-top mass spectrometer. Discontinuous atmospheric interfaces are described in Ouyang et al. (U.S. Pat. No. 8,304,718 and PCT application number PCT/US2008/065245), the content of each of which is incorporated by reference herein in its entirety.

Figure 9:
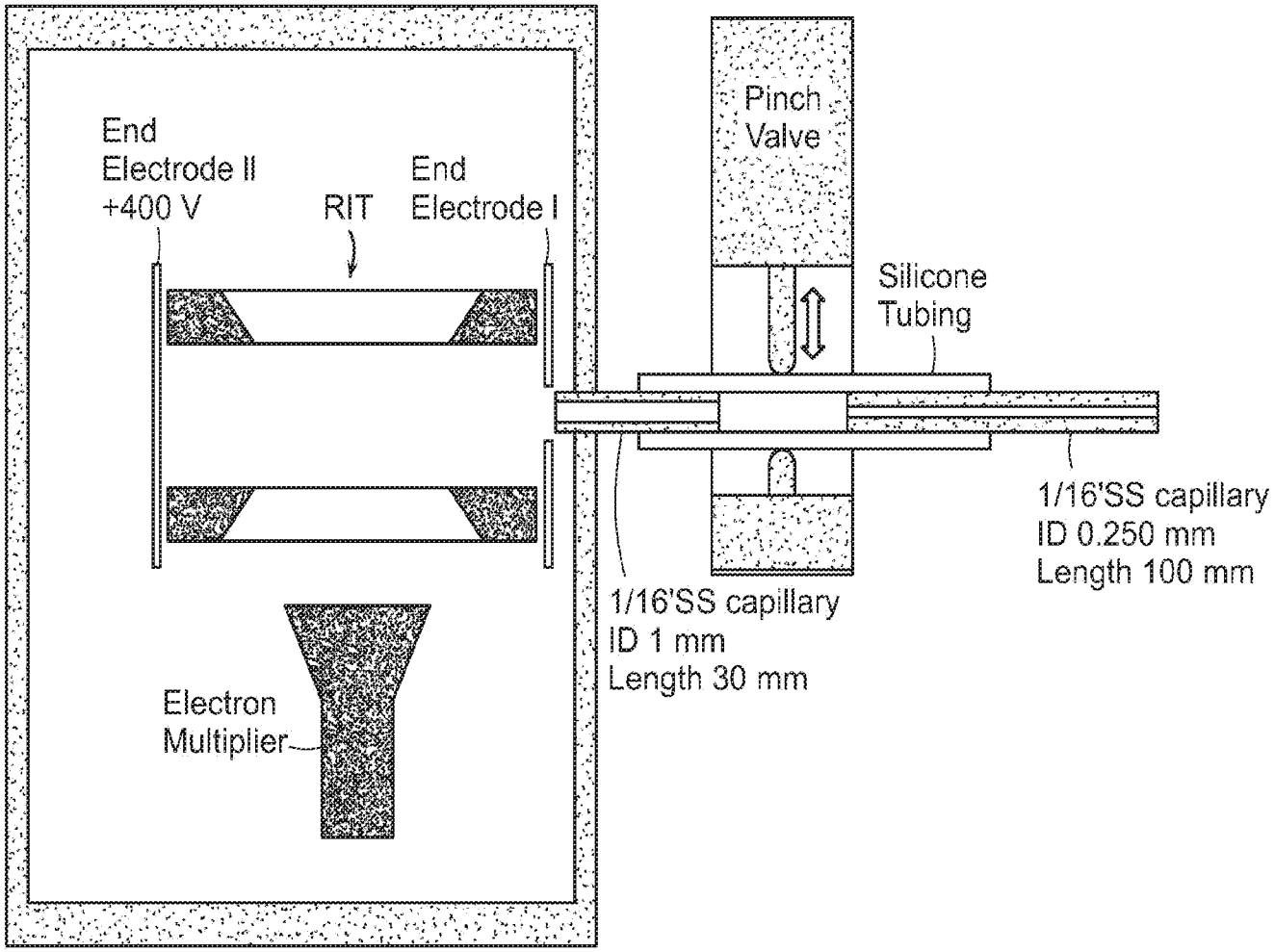
FIG. 9 shows a schematic showing a discontinuous atmospheric pressure interface coupled to a miniature mass spectrometer with rectilinear ion trap.

An exemplary DAPI is shown in FIG. 9. The concept of the DAPI is to open its channel during ion introduction and then close it for subsequent mass analysis during each scan. An ion transfer channel with a much bigger flow conductance can be allowed for a DAPI than for a traditional continuous API. The pressure inside the manifold temporarily increases significantly when the channel is opened for maximum ion introduction. All high voltages can be shut off and only low voltage RF is on for trapping of the ions during this period. After the ion introduction, the channel is closed and the pressure can decrease over a period of time to reach the optimal pressure for further ion manipulation or mass analysis when the high voltages can be is turned on and the RF can be scanned to high voltage for mass analysis.

A DAPI opens and shuts down the airflow in a controlled fashion. The pressure inside the vacuum manifold increases when the API opens and decreases when it closes. The combination of a DAPI with a trapping device, which can be a mass analyzer or an intermediate stage storage device, allows maximum introduction of an ion package into a system with a given pumping capacity.

Much larger openings can be used for the pressure constraining components in the API in the new discontinuous introduction mode. During the short period when the API is opened, the ion trapping device is operated in the trapping mode with a low RF voltage to store the incoming ions; at the same time the high voltages on other components, such as conversion dynode or electron multiplier, are shut off to avoid damage to those device and electronics at the higher pressures. The API can then be closed to allow the pressure inside the manifold to drop back to the optimum value for mass analysis, at which time the ions are mass analyzed in the trap or transferred to another mass analyzer within the vacuum system for mass analysis. This two-pressure mode of operation enabled by operation of the API in a discontinuous fashion maximizes ion introduction as well as optimizing conditions for the mass analysis with a given pumping capacity.

The design goal is to have largest opening while keeping the optimum vacuum pressure for the mass analyzer, which is between 10–3 to 10–10 torr depending the type of mass analyzer. The larger the opening in an atmospheric pressure interface, the higher is the ion current delivered into the vacuum system and hence to the mass analyzer.

An exemplary embodiment of a DAPI is described herein. The DAPI includes a pinch valve that is used to open and shut off a pathway in a silicone tube connecting regions at atmospheric pressure and in vacuum. A normally-closed pinch valve (390NC24330, ASCO Valve Inc., Florham Park, N.J.) is used to control the opening of the vacuum manifold to atmospheric pressure region. Two stainless steel capillaries are connected to the piece of silicone plastic tubing, the open/closed status of which is controlled by the pinch valve. The stainless steel capillary connecting to the atmosphere is the flow restricting element, and has an ID of 250 μm, an OD of 1.6 mm (1/16") and a length of 10 cm. The stainless steel capillary on the vacuum side has an ID of 1.0 mm, an OD of 1.6 mm (1/16") and a length of 5.0 cm. The plastic tubing has an ID of 1/16", an OD of 1/8" and a length of 5.0 cm. Both stainless steel capillaries are grounded. The pumping system of the mini 10 consists of a two-stage diaphragm pump 1091-N84.0-8.99 (KNF Neuberger Inc., Trenton, N.J.) with pumping speed of 5 L/min (0.3 m3/hr) and a TPD011 hybrid turbomolecular pump (Pfeiffer Vacuum Inc., Nashua, N.H.) with a pumping speed of 11 L/s.

When the pinch valve is constantly energized and the plastic tubing is constantly open, the flow conductance is so high that the pressure in vacuum manifold is above 30 torr with the diaphragm pump operating. The ion transfer efficiency was measured to be 0.2%, which is comparable to a lab-scale mass spectrometer with a continuous API. However, under these conditions the TPD 011 turbomolecular pump cannot be turned on. When the pinch valve is de-energized, the plastic tubing is squeezed closed and the turbo pump can then be turned on to pump the manifold to its ultimate pressure in the range of 1×10 5 torr.

The sequence of operations for performing mass analysis using ion traps usually includes, but is not limited to, ion introduction, ion cooling and AC scanning as described herein. After the manifold pressure is pumped down initially, a scan function is implemented to switch between open and closed modes for ion introduction and mass analysis. During the ionization time, a 24 V DC is used to energize the pinch valve and the API is open. The potential on the rectilinear ion trap (RIT) end electrode is also set to ground during this period. A minimum response time for the pinch valve is found to be 10 ms and an ionization time between 15 ms and 30 ms is used for the characterization of the discontinuous API. A cooling time between 250 ms to 500 ms is implemented after the API is closed to allow the pressure to decrease and the ions to cool down via collisions with background air molecules. The high voltage on the electron multiplier is then turned on and the AC voltage is scanned for mass analysis. During the operation of the discontinuous API, the pressure change in the manifold can be monitored using the micro pirani vacuum gauge (MKS 925C, MKS Instruments, Inc. Wilmington, Mass.) on Mini 10.

Incorporation by Reference

References and citations to other documents, such as patents, patent applications, patent publications, journals, books, papers, web contents, have been made throughout this disclosure. All such documents are hereby incorporated herein by reference in their entirety for all purposes.

Equivalents

Various modifications of the invention and many further embodiments thereof, in addition to those shown and described herein, will become apparent to those skilled in the art from the full contents of this document, including references to the scientific and patent literature cited herein. The subject matter herein contains important information, exemplification and guidance that can be adapted to the practice of this invention in its various embodiments and equivalents thereof.

EXAMPLES

A mass spectrum can be recorded by scanning the frequency of a low amplitude AC signal applied so as to establish an approximately dipolar field in a 2D or 3D quadrupole ion trap of linear, rectilinear, cylindrical or other geometry. The AC signal is applied so as to eject trapped ions through resonance with their secular (or related) frequency for collection at an external detector. The ejection is performed while the ions are trapped in the (approximately) quadrupolar field established by applying the main trapping RF to the electrode structure. Neither the amplitude nor the frequency of the main RF need be scanned to record a mass spectrum. The data herein can be extended to cover operation of a quadrupole mass filter operated at low mass resolution (broad bandpass mode) so as to mass-selectivity eject ions by scanning the frequency of a supplementary AC signal applied to establish a dipolar field orthogonal to the direction of ion motion through the mass filter.

Scanning the frequency of a supplementary AC signal used to superimpose a small dipole field on a main trapping quadrupolar field allows a mass/charge spectrum to be recorded. The simplification in the electronics achieved by frequency scanning a low amplitude signal is particularly useful to small, miniature mass spectrometer systems. The supplementary signal can be in resonance with the secular frequency of the trapped ions or with a related frequency. The relaxation of the dimensional tolerances of the electrode structures that is possible in this mode of operation compared to conventional quadrupole mass filters is a further advantage for small, miniature systems. The ion trap can be hyperbolic, cylindrical, linear, or rectilinear ion trap with either 2D or 3D trapping fields or it can be a 2D mass filter.

The trapped ion population from which ions are resonantly ejected can cover a wide range of m/z values (from the low mass cut-off value in the ion trap to essentially unlimited high values) or it can be a much narrower range, chosen by the $V_{RF}/U$ ratio in the mass filter case. The applied AC frequency can be single-valued or a range of frequencies can be used, for example those created in a SWIFT experiment.

By control of the AC amplitude, the ion trap can be operated to first activate a selected ion or population of ions, and then, using the frequency scan, to interrogate the products of the activation process. That is to perform product ion MS/MS scans. In one embodiment, ions are trapped in an ion trap. The AC signal is applied so as to eject trapped ions through resonance with their secular (or related) frequency to a second ion trap. This allows the measurement of precursor ion MS/MS spectra in a mass filter or linear ion trap.

Example 1

Ion Trap Operated with Varied AC and Constant RF

FIG. 1 shows timing diagrams for operating a quadrupole ion trap with a constant RF and an AC scan and a typical RF scan in a quadrupole ion trap. FIG. 1 shows the voltages that are scanned in a typical RF mass-selective instability scan and in the new AC frequency scan in the case of a quadrupole ion trap.

The ejection of ions by the AC voltage occurs at different values of $q_z$ in the AC scanning operation of the ion trap. Under the AC frequency scan conditions, the pseudo-potential well depth is different for ions of different m/z ratios. It might therefore be useful to scan $V_{ac}$ with $\omega_{ac}$ to optimize ejection and resolution. The pseudo-potential well depth in the direction u (x, y, z as appropriate) varies with $q_z$ according to the standard Dehmelt equation (Equation 2) as follows:

$$D_u=[(m/z)q_u^2\Omega_{RF}^2u_0^2]/16 \text{ for } q_u<0.7 \qquad \text{Equation 2}$$

but m/z is itself a function of $q_u$ and when operated at fixed $V_{RF}$, and $\Omega_{RF}$ the well depth $D_u=[V_{RF}q_u]/2$. It would be a straightforward matter to scan $V_{ac}$ to obtain an approximately constant well depth or otherwise to optimize $V_{ac}$ to maximize performance.

Example 2

Analysis of Methyl Salicylate

Figure 2:
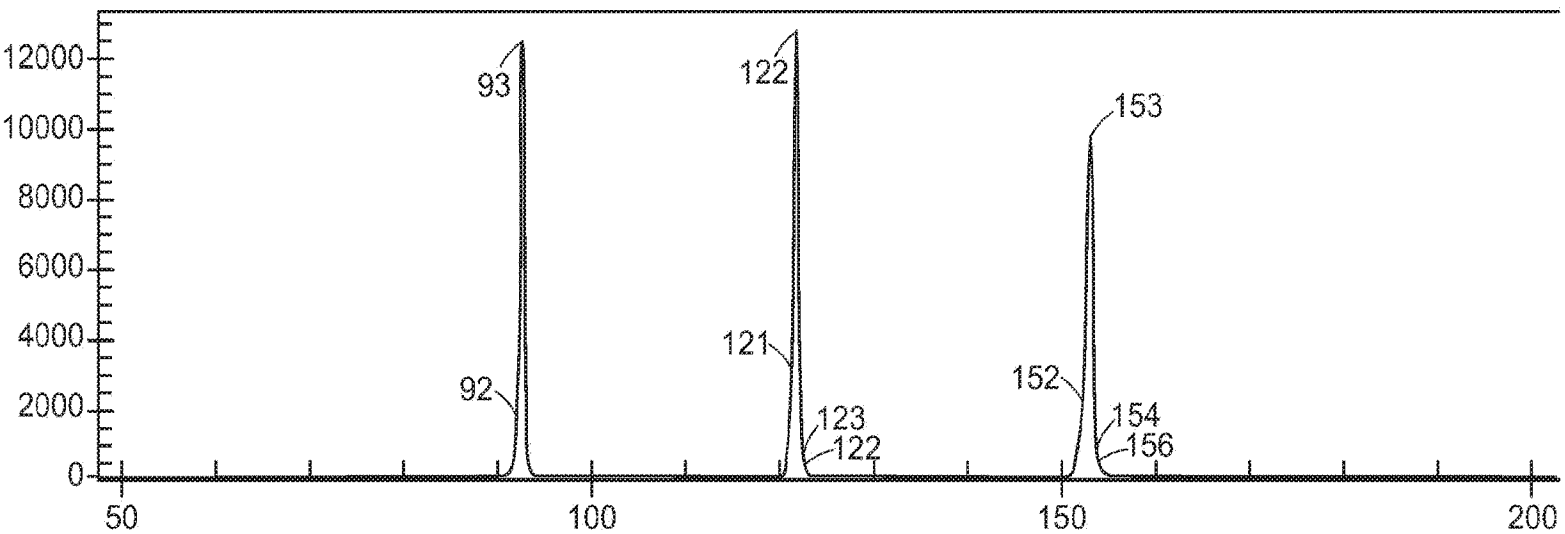
FIG. 2 shows a typical electron ionization mass spectrum of methyl salicylate (MW 152) acquired using a standard RF amplitude ramp in a cylindrical ion trap.
Figure 3:
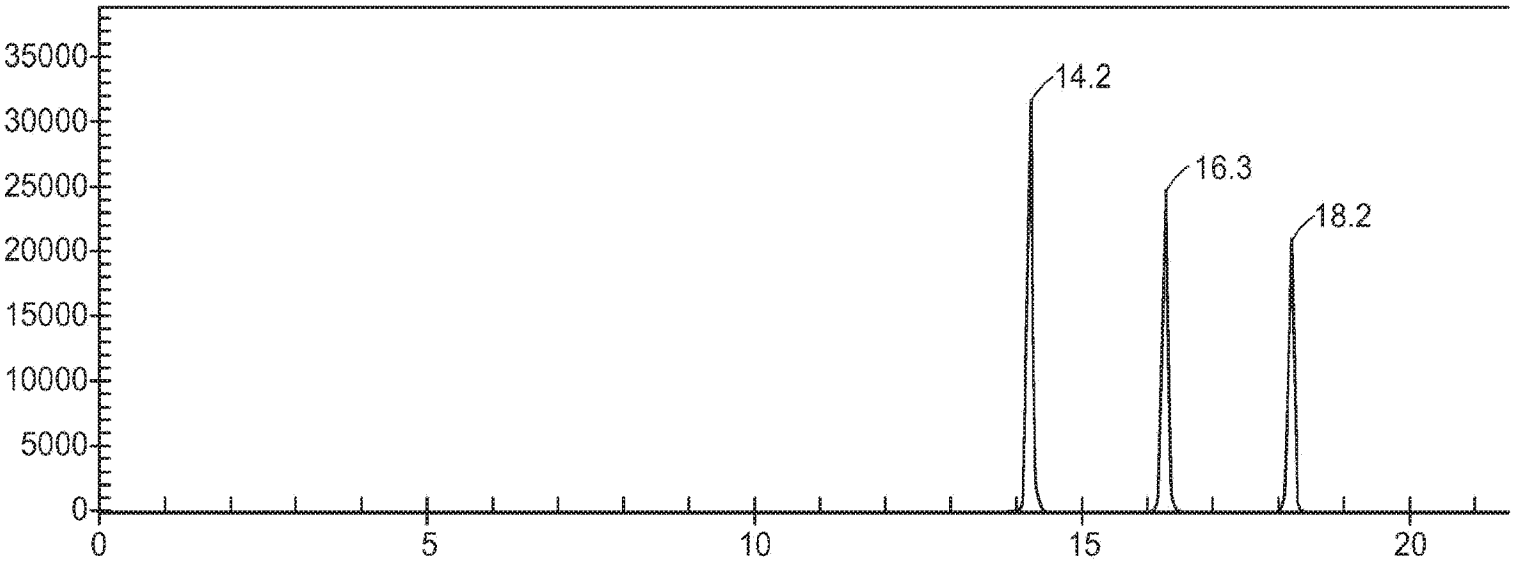
FIG. 3 shows an electron ionization mass spectrum of methyl salicylate (MW 152) recorded using an AC frequency scan at a constant RF trapping voltage set so that the low-mass cutoff is at m/z 50. The peaks at 14.2, 16.3 and 18.2 msec correspond to ions of m/z 92, 120 and 152, respectively (x-axis: time in msec; y-axis: intensity in arbitrary units).

FIG. 2 shows a mass spectrum that was recorded using a Griffin Analytical Systems cylindrical ion trap instrument operated in the electron ionization mode using the normal mass selective instability scan mode and under the following operating conditions: AC frequency 350 kHz, RF 1.5 MHz. FIG. 2 shows the typical electron ionization mass spectrum of methyl salicylate (MW 152) acquired using a standard RF amplitude ramp in a cylindrical ion trap. Note that the calibration is slightly in error as the expected peaks are at m/z 92, 120 and 152 (x-axis units are approximate m/z values; y-axis units are intensity, arbitrary units). FIG. 3 shows an electron ionization mass spectrum of methyl salicylate (MW 152) recorded using an AC frequency scan at a constant RF trapping voltage set so that the low-mass cutoff is at m/z 50. The peaks at 14.2, 16.3 and 18.2 msec correspond to ions of m/z 92, 120 and 152, respectively (x-axis: time in msec; y-axis: intensity in arbitrary units).

Example 3

Analysis of 1,3-Dibromopropane

Figure 4:
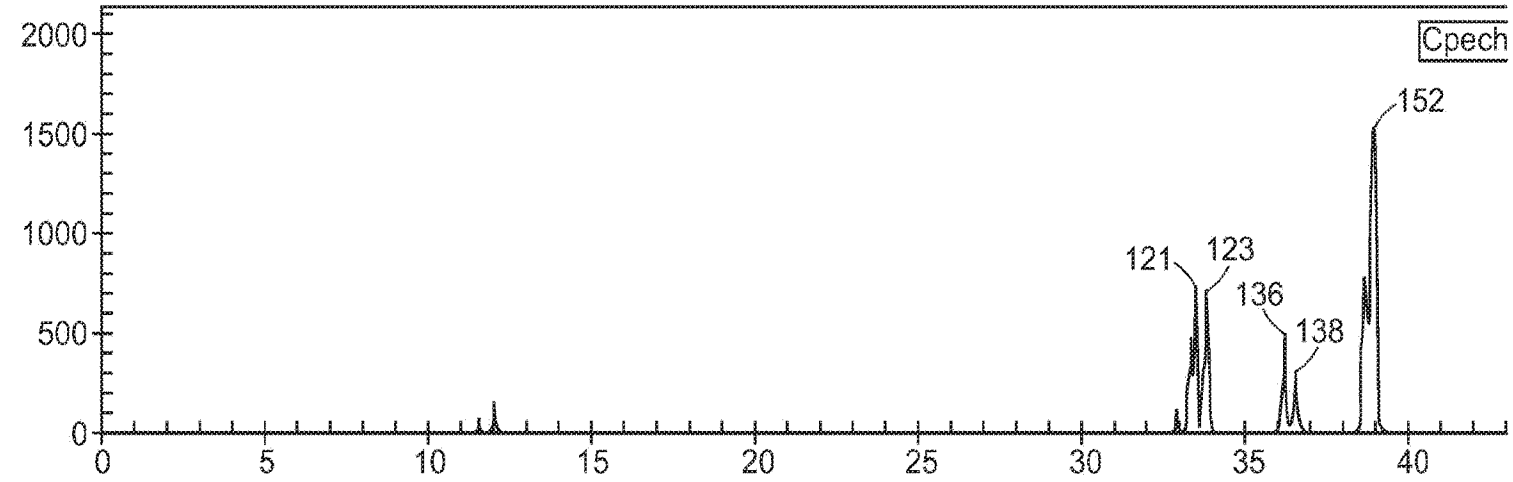
FIG. 4 shows an electron ionization mass spectrum of 1,3-dibromopropane recorded by sweeping the AC frequency while operating at an AC amplitude of approximately 0.4 volts in a cylindrical ion trap with the RF trapping voltage set such that the low-mass cutoff was m/z 70. The peak at m/z 152 is background from methyl salicylate.

To test if coalescence of two ions of similar m/z would limit the mass resolution, a brominated compound was analyzed. 1,3-Dibromopropane was chosen as it contains isotopic peaks of similar intensity that are separated by m/z 2. FIG. 4 shows its electron ionization mass spectrum recorded using the new AC frequency scan.

Example 4

AC Scanning Using a Linear Ion Trap

Figure 5:
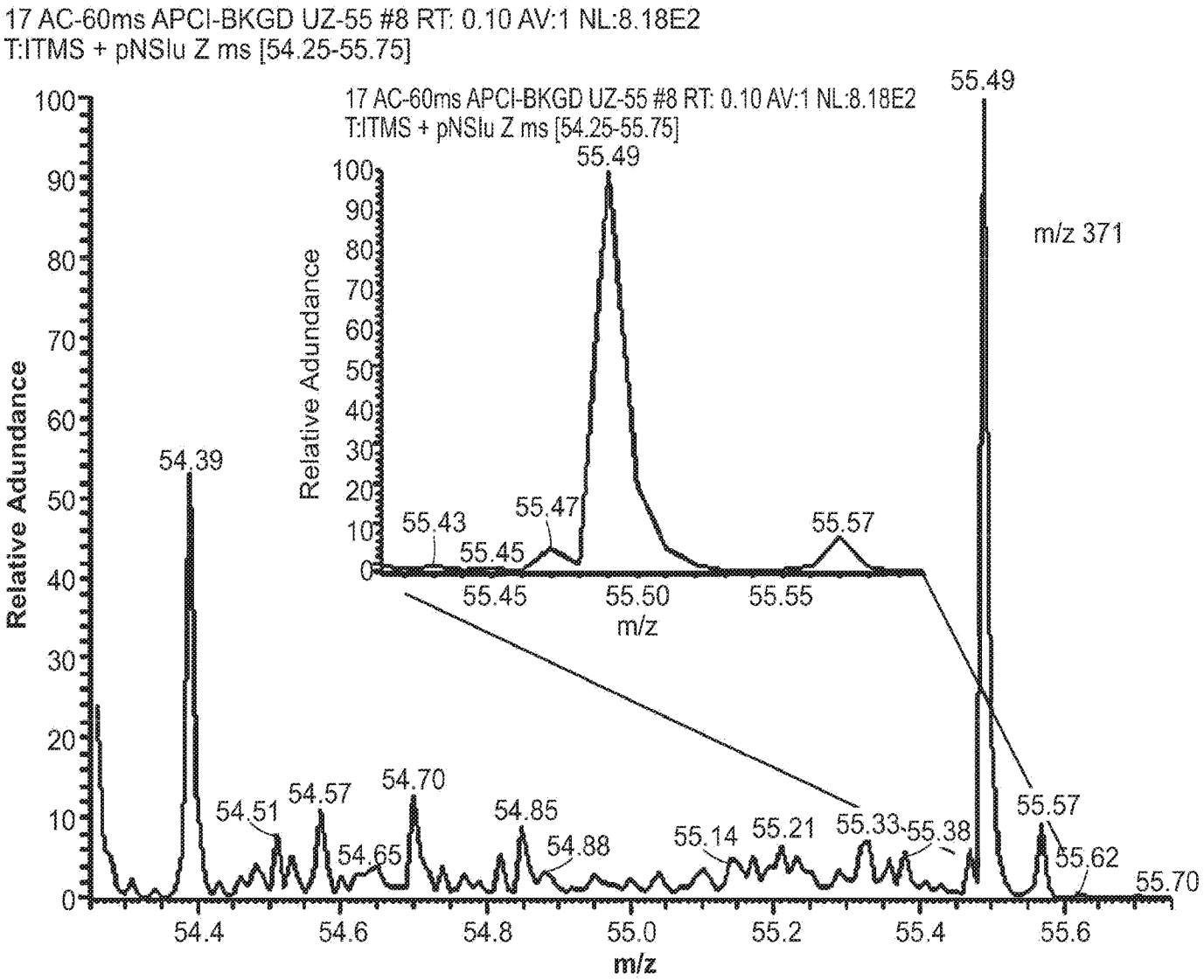
FIG. 5 shows an APCI background mass spectrum acquired using a Thermo LTQ at with an AC frequency sweep from 200-10 kHz at 0.8 VP-P, while the RF amplitude scans over a very narrow range from m/z 54.25-55.75 and a scan time of 60 msec. The insert is zoomed in for a region of ions from approximately m/z 360-390. Note that the calibration refers to the masses that would be ejected by the RF scan: m/z 55.38, 55.49 and 55.57 but these correspond to m/z 355, 371 and 388, respectively.
Figure 6:
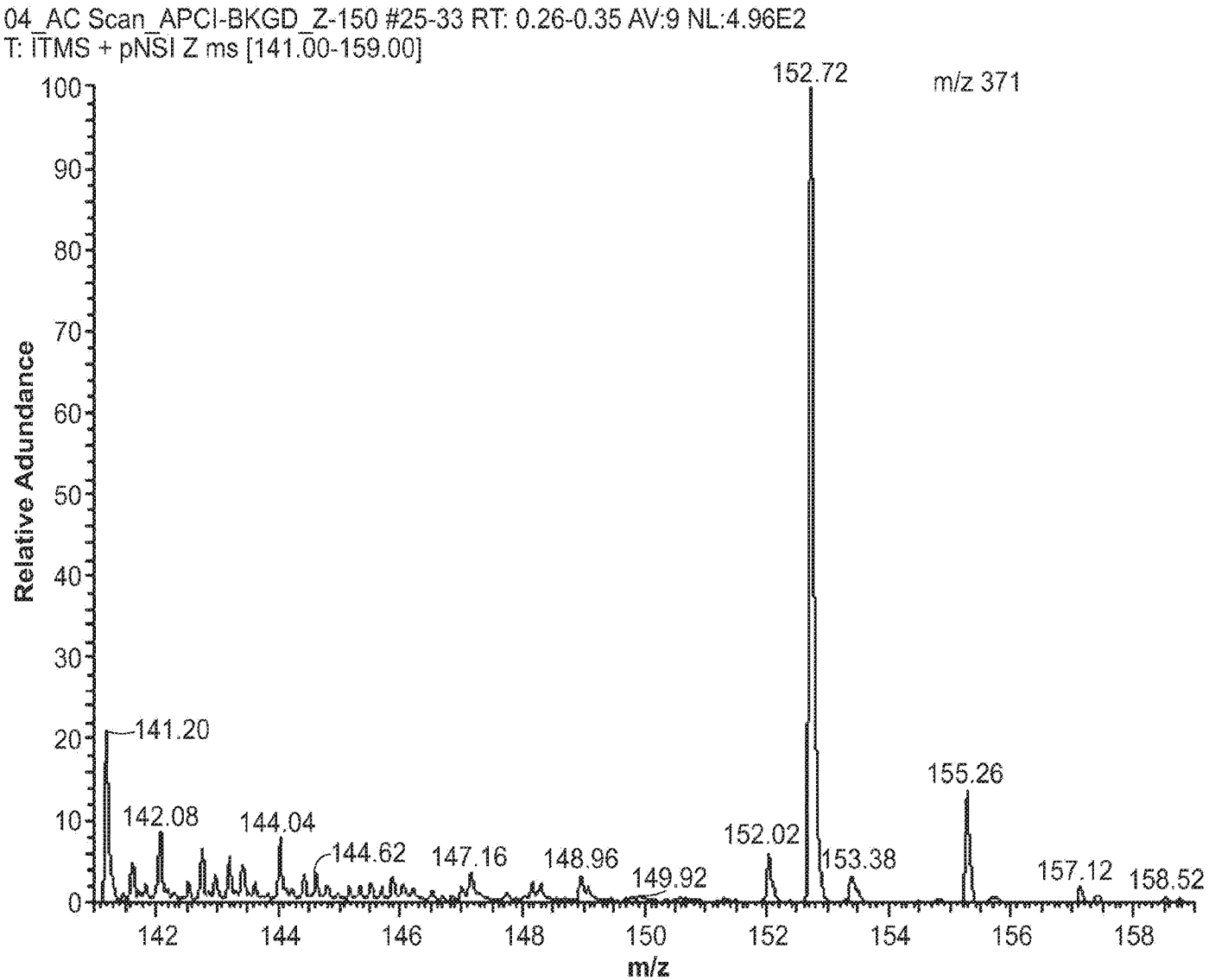
FIG. 6 shows an APCI background mass spectrum acquired on a Thermo LTQ using an AC frequency sweep from 250-50 kHz at 0.8 VP-P, while the RF amplitude is scanned from m/z 141-159 in a scan time of 20 msec. Note the calibration refers to the masses that would be ejected by the RF scan: peaks at m/z 152.0, 152.7, 153.4 and 155.3 correspond to m/z 355, 371, 388, and 445 respectively.
Figure 7:
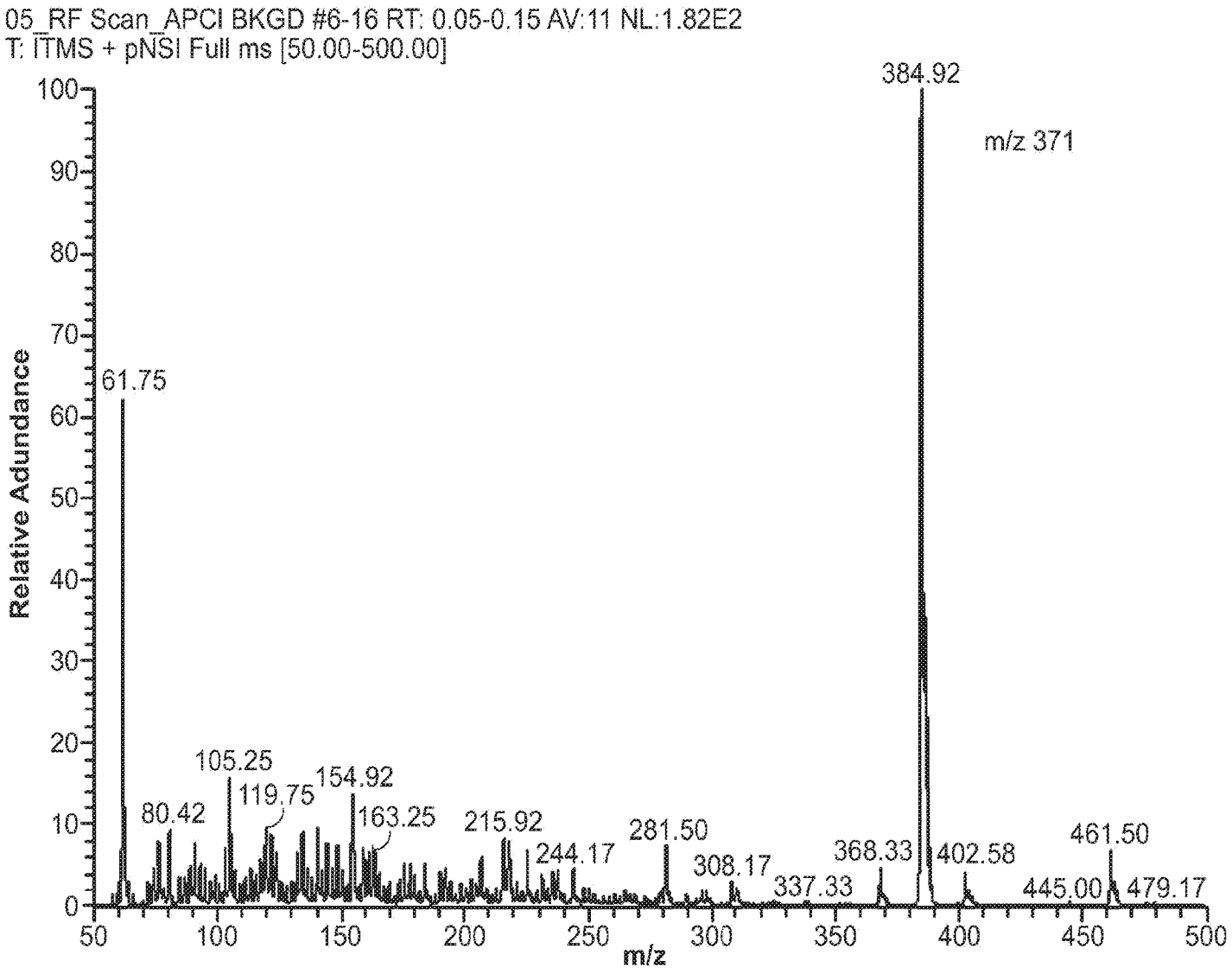
FIG. 7 shows an APCI background mass spectrum acquired on a Thermo LTQ using a boundary-ejection RF scan from m/z 50-500.

The AC frequency scan was also tested using a linear ion trap to ensure its applicability to a trap of a different geometry and larger size. FIGS. 5-7 show mass spectra acquired using a Thermo LTQ with either an AC frequency scan or boundary-ejection RF scan (as indicated). Note that in order to implement the AC frequency scan on the LTQ, it was necessary to trigger the AC frequency sweep during data acquisition. The ejection and detection of ions with the AC frequency sweep used scan periods of 20-60 msec.

What is claimed is:

1. A system, the system comprising:

a mass spectrometer comprising an ion trap; and a central processing unit (CPU), and storage coupled to the CPU for storing instructions that when executed by the CPU cause the system to:

apply a constant radio frequency (RF) signal to the ion trap; and apply an alternating current (AC) signal to the ion trap in a manner wherein frequency and amplitude of the AC signal are varied such that application of the AC signal gives rise to an approximately constant well depth.

2. The system according to claim 1, wherein the AC signal is in resonance with a secular frequency of ions trapped within the ion trap.

3. The system according to claim 1, wherein the ion trap is selected from the group consisting of: a hyperbolic ion trap, a cylindrical ion trap, a linear ion trap, a rectilinear ion trap.

4. The system according to claim 1, wherein the mass spectrometer is a miniature mass spectrometer.

5. The system according to claim 1, wherein a first detector of the mass spectrometer is positioned orthogonal to the ion trap such that unstable ions are ejected from the ion trap and are received at the first detector.

6. The system according to claim 1, wherein a first detector of the mass spectrometer is positioned in-line with the ion trap such that stable ions that pass through the ion trap are received at the first detector, and a second detector of the mass spectrometer is positioned orthogonal to the ion trap such that unstable ions ejected from the ion are received at the second detector.

7. The system according to claim 1, further comprising an ionization source.

8. The system according to claim 1, further comprising a discontinuous interface.

9. A method for operating an ion trap of a mass spectrometer, the method comprising:

applying a constant radio frequency (RF) signal to an ion trap of a mass spectrometer; and applying an alternating current (AC) signal to the ion trap in a manner wherein frequency and amplitude of the AC signal are varied such that application of the AC signal gives rise to an approximately constant well depth.

10. The method according to claim 9, wherein the AC signal is in resonance with a secular frequency of ions trapped within the ion trap.

11. The method according to claim 9, wherein the ion trap is selected from the group consisting of: a hyperbolic ion trap, a cylindrical ion trap, a linear ion trap, a rectilinear ion trap.

12. The method according to claim 9, wherein the mass spectrometer is a miniature mass spectrometer.

13. The method according to claim 9, wherein a first detector of the mass spectrometer is positioned orthogonal with the ion trap such that unstable ions are ejected from the ion trap and are received at the first detector.

14. The method according to claim 9, wherein a first detector of the mass spectrometer is positioned in-line with the ion trap such that stable ions that pass through the ion trap are received at the first detector, and a second detector of the mass spectrometer is positioned orthogonal to the ion trap such that unstable ions ejected from the ion are received at the second detector.

15. The method according to claim 9, further comprising detecting ions ejected from the ion trap resulting from application of the AC signal to the ion trap.

16. The method according to claim 9, wherein ions are discontinuously introduced into the ion trap.

* * * * *